US006443451B1

(12) United States Patent
Cheever

(10) Patent No.: US 6,443,451 B1
(45) Date of Patent: Sep. 3, 2002

(54) APPARATUS FOR RANDOMLY DISPENSING OBJECTS, KIT, AND METHOD OF PLAYING A GAME

(76) Inventor: Richard C. Cheever, Rte. 3A, P.O. Box 268, Hill, NH (US) 03243

( * ) Notice: Subject to any disclaimer, the term of this patent is extended or adjusted under 35 U.S.C. 154(b) by 0 days.

(21) Appl. No.: 09/656,727

(22) Filed: Sep. 7, 2000

(51) Int. Cl.[7] ..... A63B 71/00

(52) U.S. Cl. ..... 273/138.1; 273/138.1; 273/448; 221/4; 221/12; 221/13; 221/17

(58) Field of Search ..... 273/138.1, 448, 273/142 R, 440, 147, 129 W; 221/4, 12, 13, 17, 42, 191, 204, 205, 30, 251

(56) References Cited

U.S. PATENT DOCUMENTS

| | | | | | |
|---|---|---|---|---|---|
| 417,137 | A | * | 12/1889 | Berge | 221/204 |
| 2,439,475 | A | * | 4/1948 | Kruse | 312/48 |
| 2,464,737 | A | * | 3/1949 | Wellekens | 312/97.1 |
| 2,466,269 | A | * | 4/1949 | Penn | 221/204 |
| 2,482,245 | A | * | 9/1949 | Childers | 312/97.1 |
| 3,217,925 | A | * | 11/1965 | Thomas | 221/7 |
| 4,124,144 | A | * | 11/1978 | Radek | 221/191 |
| 4,607,650 | A | * | 8/1986 | Kobayashi et al. | 133/5 R |
| 4,701,900 | A | * | 10/1987 | Hasegawa et al. | 369/36 |
| 5,014,906 | A | * | 5/1991 | Gero | 229/123 |
| 5,071,033 | A | * | 12/1991 | Siwek | 221/229 |
| 5,108,006 | A | * | 4/1992 | Tieke et al. | 221/152 |
| 5,167,345 | A | * | 12/1992 | Bleeker | 221/17 |
| 5,605,249 | A | * | 2/1997 | Gonyea | 221/6 |
| 5,664,698 | A | * | 9/1997 | Nottongham et al. | 222/2 |
| 5,713,489 | A | * | 2/1998 | Loos | |
| 5,848,731 | A | * | 12/1998 | Deering | 222/129 |
| 6,206,235 | B1 | * | 3/2001 | Green | 221/251 |
| 6,234,345 | B1 | * | 5/2001 | Minh et al. | 221/124 |

FOREIGN PATENT DOCUMENTS

| | | | | |
|---|---|---|---|---|
| ES | 0349697 A! | * | 10/1990 | A47F/1/08 |

* cited by examiner

*Primary Examiner*—Benjamin H. Layno
*Assistant Examiner*—D Collins
(74) *Attorney, Agent, or Firm*—Michael J Persson; Lawson, Philpot & Persson P.C.

(57) ABSTRACT

The present invention is an apparatus for randomly dispensing objects, such as chocolate candies, a kit of parts, and a method for playing games, or educational exercises. that utilizes the random dispenser apparatus. The apparatus includes a housing having a substantially hollow interior portion for holding a plurality of the objects and a dispensing opening dimensioned to allow a single object to be dispensed. An object sorter is provided for aligning the objects for individual dispensing through the dispensing opening of the housing. Finally, an actuator is provided for individually dispensing the single object from the object sorter through the dispensing opening of the housing. In operation, the objects are held within the housing and are randomly aligned within the object sorter such that a user will not know which of the objects will be dispensed when the actuator is actuated. The objects are then dispensed through the dispensing opening in the housing when the actuator is actuated.

17 Claims, 8 Drawing Sheets

APPARATUS FOR RANDOMLY DISPENSING OBJECTS, KIT, AND METHOD OF PLAYING A GAME

FIELD OF THE INVENTION

The present invention relates to the field of object dispensers and, in particular, to a dispenser for randomly dispensing objects and a method of playing a game, or performing a mathematical exercise. utilizing such a dispenser.

BACKGROUND OF THE INVENTION

The manufacturing and sale of candy is a highly competitive business. The competitive nature of the business is demonstrated by the vast array of candy types and brands of the same type of candy that arc available in the marketplace. Because of the competitive nature of the business, candy manufactures invest significant sums of money on advertising and on promotional items in an attempt to gain name recognition for their products.

One company that has been particularly aggressive in its advertising and promotional activities has been Mars. Inc. of Hackettstown N.J. Mars, Inc., is the manufacturer and distributor of numerous candies, including M&M's® Chocolate Candies, and has engaged in an ongoing advertising and promotional campaign for these candies. As part of this campaign, the company has purchased television advertisements featuring their candies in humanoid form, sponsored a NASCAR Winston Cup Series® racing team, and has operated a World Wide Web site at "m-ms.com" from which it sells a number of products bearing the M&M's® logo's and copyrighted images.

Among the products sold on the Mars. Inc., Web site are a number of activities and games. These activities and games all utilize non-candy facsimiles of the candies and humanoid candy characters featured in their television advertising and are directed to such activities as art, counting and pretending. Although these activities and games are successful at promoting the M&M® trademark and at raising the awareness of the product. they do not directly promote the sale of the candies themselves.

One way that the sale of candies is promoted by the Mars, Inc., is through the sale of candy dispensers. These dispensers come in a number of styles ranging from traditional "gumball" type dispensers, to dispensers featuring the humanoid candy characters in various poses. These dispensers will typically be filled with the candies dispense a handful of candies from a candy reservoir when they are actuated by a user. In this respect, these dispensers are successful at promoting the trademark and in directly promoting the sale of the candies themselves. However, children quickly become bored with a single function dispenser and, once emptied of its contents, the dispensers are unlikely to be refilled. In addition, these dispensers are fairly large in size and cannot be easily transported in a pocket, purse or backpack.

Therefore, there is a need for a children's game or activity that will both promote the M&M's® trademark, will directly promote the sale of the candies themselves, and will keep the attention of children for a relatively long period of time, and for a candy dispenser that is easily transportable in a pocket, purse or backpack.

SUMMARY OF THE INVENTION

The present invention is an apparatus for randomly dispensing objects, such as the chocolate candies sold under the M&M's® trademark, a kit of parts, and a method for playing a game that utilizes the random dispenser apparatus.

In its most basic form, the apparatus for randomly dispensing objects includes a housing having a substantially hollow interior portion for holding a plurality of the objects and a dispensing opening dimensioned to allow a single object to be dispensed. An object sorter is provided for aligning the objects for individual dispensing through the dispensing opening of the housing. Finally, an actuator is provided for individually dispensing the single object from the object sorter through the dispensing opening of the housing. In operation, the objects are held within the housing and are randomly aligned within the object sorter such that a user will not know which of the objects will be dispensed when the actuator is actuated. The objects are then dispensed through the dispensing opening in the housing when the actuator is actuated.

In the preferred embodiment of the apparatus, the objects are saucer shaped candies, such as those sold under the trademark M&M's® Chocolate Candies, and the dispensing opening of the housing is dimensioned to allow a single candy to be dispensed.

The preferred housing has a top portion and a bottom portion that are attached together about the periphery of the housing, a dispensing opening disposed through the periphery of the housing and a fill opening for filling the housing with saucer shaped candies. The top portion of the preferred housing includes a guard member extending downward into the interior portion of the housing, and a pair of sloped portions proximate to the guard member and dispensing opening. The guard member is dimensioned and disposed a sufficient distance from the dispensing opening such that only the single candy may be dispensed when the plunger is depressed. while the sloped portions dimensioned to prevent more than a single candy from entering the object sorter at one time.

The preferred actuator includes a plunger disposed through the top portion of the housing and a slotted post extending from the bottom portion of the housing. The plunger includes a first hollow shaft having an inside diameter dimensioned to fit around the post. A pin is disposed across the inside diameter of the first hollow shaft, extends through an outer surface of the shaft, and is dimensioned to fit within the slot in the post to prevent rotation of the plunger. A spring is disposed within the first hollow shaft and is dimensioned to engage the pin when the plunger is depressed.

The preferred object sorter includes an object opening dimensioned to allow the single candy to be dispensed, a sorting channel, and a second hollow shaft having an inside diameter dimensioned to fit about the first hollow shaft. The sorting channel is dimensioned to align a plurality of candies for dispensing and to accept and align an additional candy when a candy has been dispensed. The second hollow shaft includes a cam slot dimensioned to accept the pin and to cause the object sorter to rotate about the first hollow shaft when the plunger is depressed. When the preferred actuator and object sorter are combined, depressing the plunger causes the object sorter to rotate a sufficient distance to align the object opening of the object sorter with the dispensing opening of the housing such that the single candy is dispensed. When the plunger is released, the object sorter rotates back into position and an additional candy is accepted into the sorting channel.

The kit of the present invention includes a plurality of objects, and an apparatus as described above. In the preferred kit the objects are saucer shaped candies, and the kit includes at least one game card that is dimensioned to accept the saucer shaped candies.

The method of the present invention includes the steps of inserting a plurality of objects into a dispenser, randomly dispensing at least a first object from the dispenser, passing the dispenser to another player. randomly dispensing at least a second object from the dispenser, repeating the dispensing steps until the game is completed, and determining a winner of the game based upon the objects that have been dispensed. In the preferred method, game cards are used and the method includes the steps of placing the objects into the game cards.

Therefore, it is an aspect of the invention to provide a children's game or activity that will promote the M&M's® trademark.

It is a further aspect of the invention to provide a children's game or activity that will directly promote the sale of candies.

It is a further aspect of the invention to provide a children's game or activity that will keep the attention of children for a relatively long period of time.

It is a further aspect of the invention to provide a children's game or activity that utilizes a dispenser that will randomly dispense a single candy at a time.

It is a further aspect of the invention to provide a children's activity that may be used as a learning tool.

It is a still further aspect of the invention to provide a children's game or activity that utilizes a dispenser that utilizes a dispenser that requires no external power source. such as batteries or the like.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF T HE INVENTION

Figure 2:
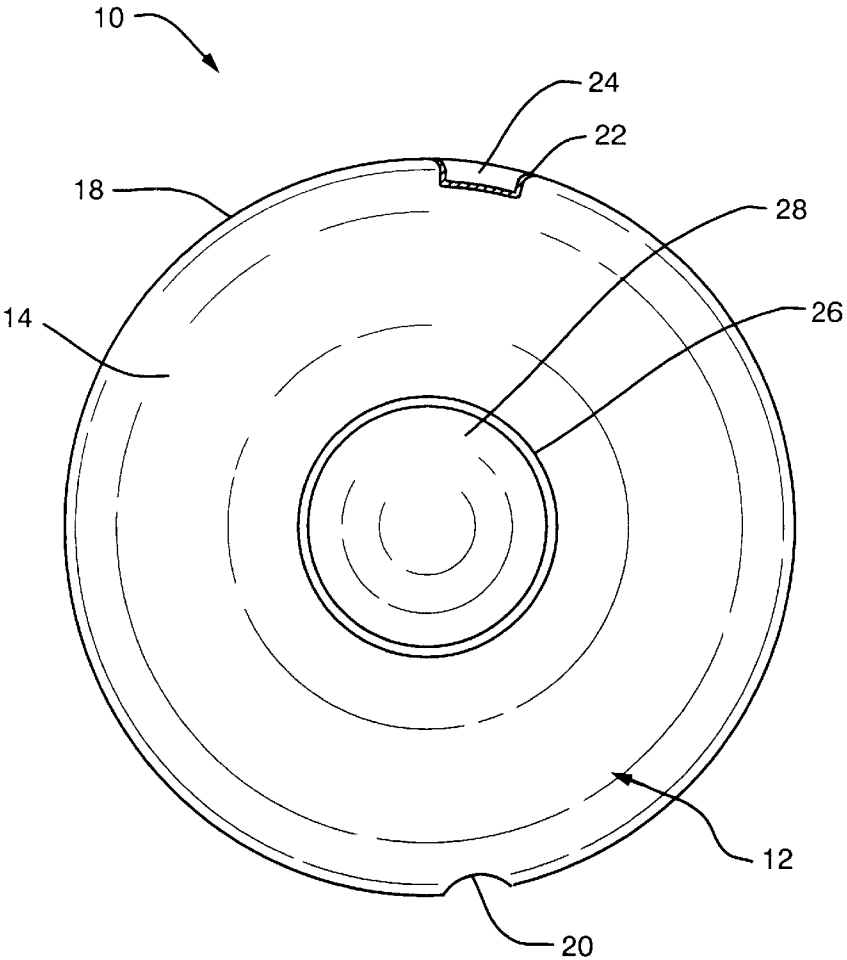
FIG. 2 is a top view of the dispensing apparatus of FIG. 1.
Figure 1:
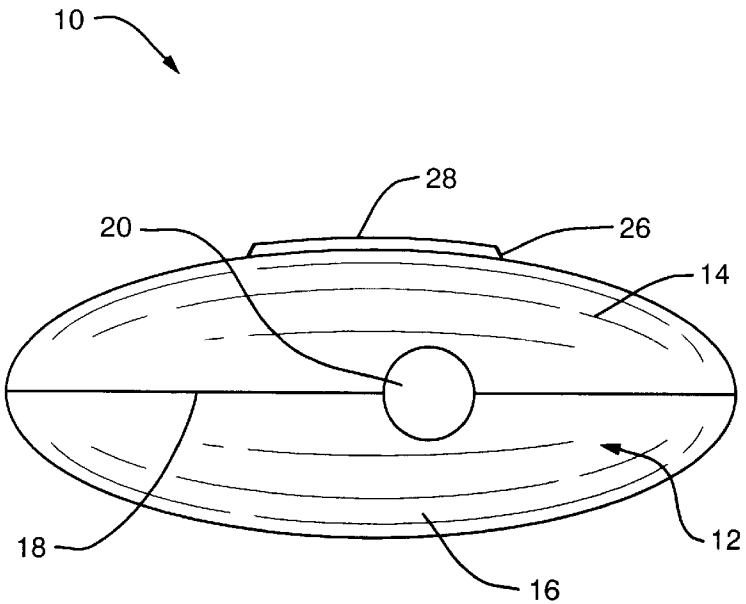
FIG. 1 is a side view of the preferred dispensing apparatus of the present invention.

Referring first to FIGS. 1 and 2, the preferred dispensing apparatus 10 is adapted to randomly dispense saucer shaped candies, such as those sold under the trademark M&M's® Chocolate Candies, and includes a hollow housing 12 that is also substantially saucer shaped and dimensioned to fit into a user's hand. A saucer shaped housing 12 is preferred as it promotes the M&M's® trademark and will directly promote the sale of the candies themselves by indicating that M&M's® Chocolate Candies should be used to fill the housing 12. It is understood, however, that the housing 12 may take a variety of forms and, therefore, the scope of the invention should not be limited to this preferred embodiment.

The preferred housing 12 has a top portion 14 and a bottom portion 16 that are attached together about the periphery 18 of the housing 12. The top portion 14 of the preferred housing 12 includes an opening 26 through which a plunger 28 is disposed. A dispensing opening 20 is disposed through the periphery 18 of the housing 12 and is dimensioned to allow only a single candy to be dispensed at one time. A fill opening 22 for filling the housing 12 with saucer shaped candies is disposed through another portion of the periphery 18 of the housing 12. The fill opening 22 is dimensioned to allow multiple candies to be disposed within the housing 12 and is fitted with a fill plug 24 that allows the housing 12 to be sealed once it has been filled with candies.

Figure 3:
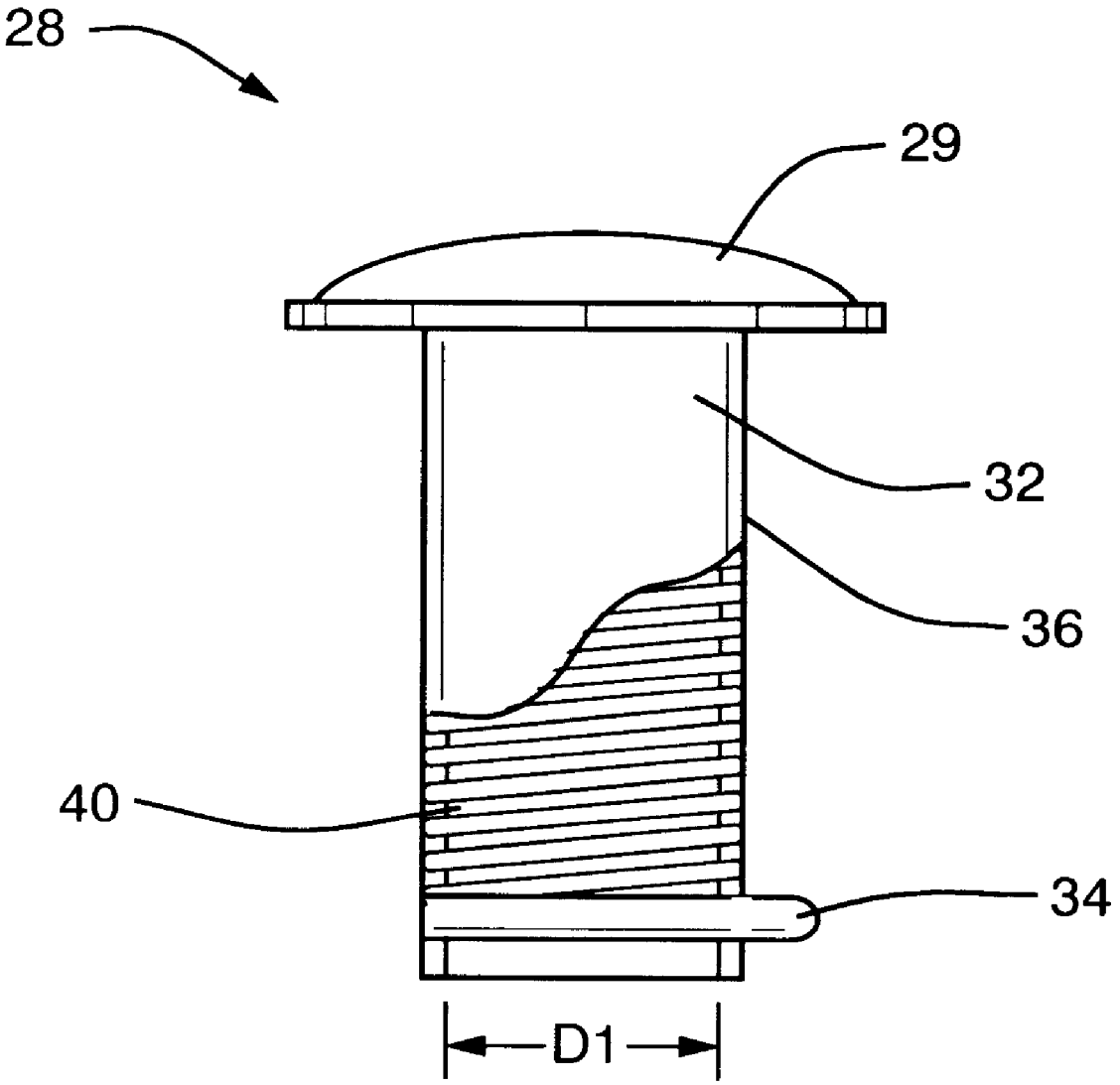
FIG. 3 is a side view of the preferred plunger with the bottom portion of the first hollow shaft cut away to reveal the pin and spring.
Figure 4:
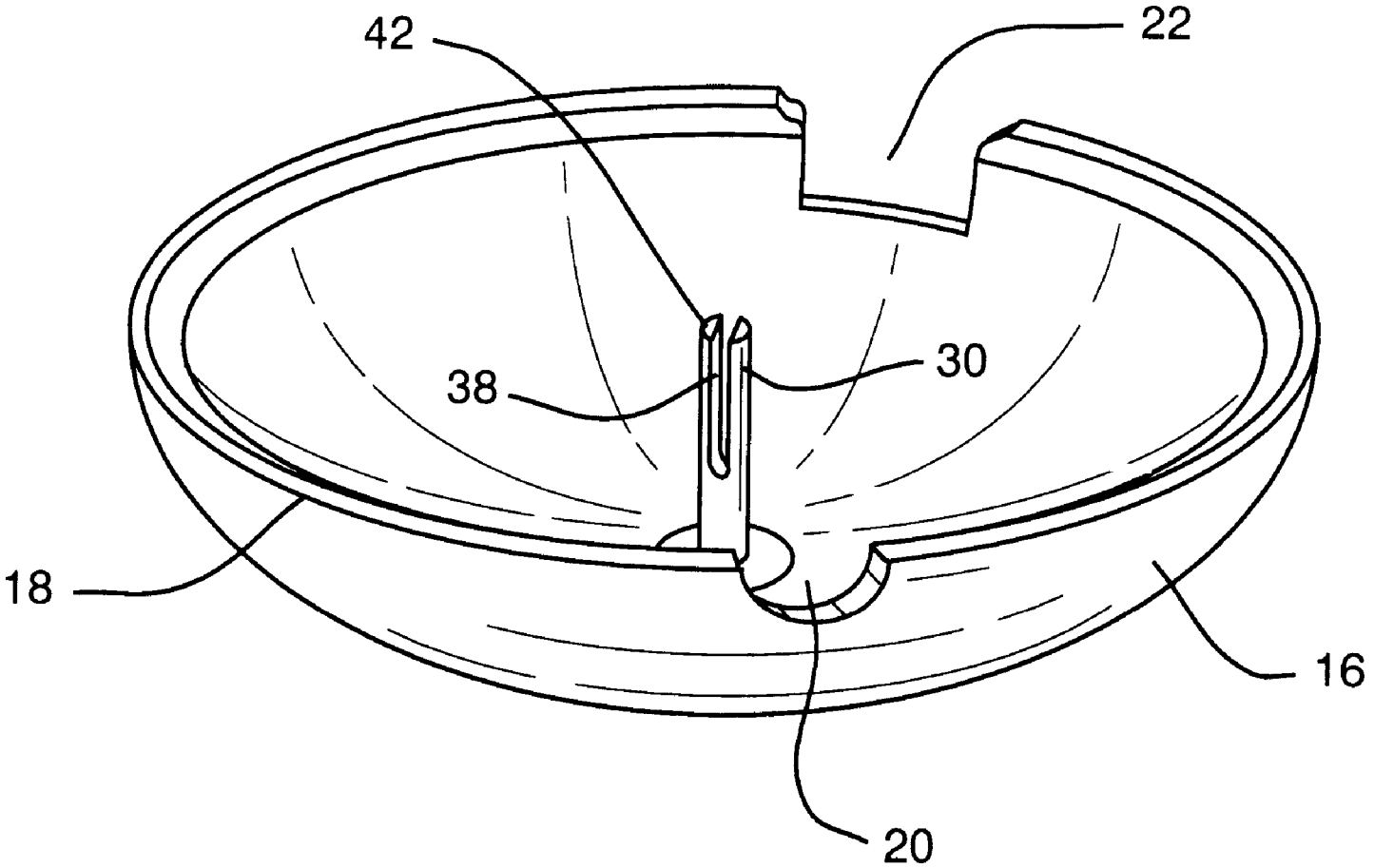
FIG. 4 is a top isometric view of the inside of the bottom portion of the preferred housing.

The apparatus 10 includes an actuator for individually dispensing a single object through the dispensing opening 20 of the housing 12. Referring to FIGS. 3 and 4, the preferred actuator includes a plunger 28, which is disposed through the top portion 14 of the housing 12, and a slotted post 30 that extends from the bottom portion 16 of the housing 12. The plunger 28 includes a button top 29 that is dimensioned to follow the contour of the surface of the top portion of the housing. The button top 29 is attached to a first hollow shaft 32, which extends downward from the button top 29. The first hollow shaft 32 is substantially cylindrical and has an inside diameter D1 that is dimensioned to fit around the outside of the post 30. A pin 34 is disposed across the inside diameter D1 of the first hollow shaft 32 and extends through an outer surface 36 of the shaft 32. The pin 34 is dimensioned to fit within the slot 38 in the post 30 to prevent rotation of the plunger lo 28 when it is depressed. A spring 40 is disposed within the first hollow shaft 32 and is retained by the pin 34. The spring 40 is dimensioned to engage the top 42 of the post 30 when the plunger 28 is depressed in order to return the plunger 28 to its undepressed position upon dispensing of a candy.

Figure 5:
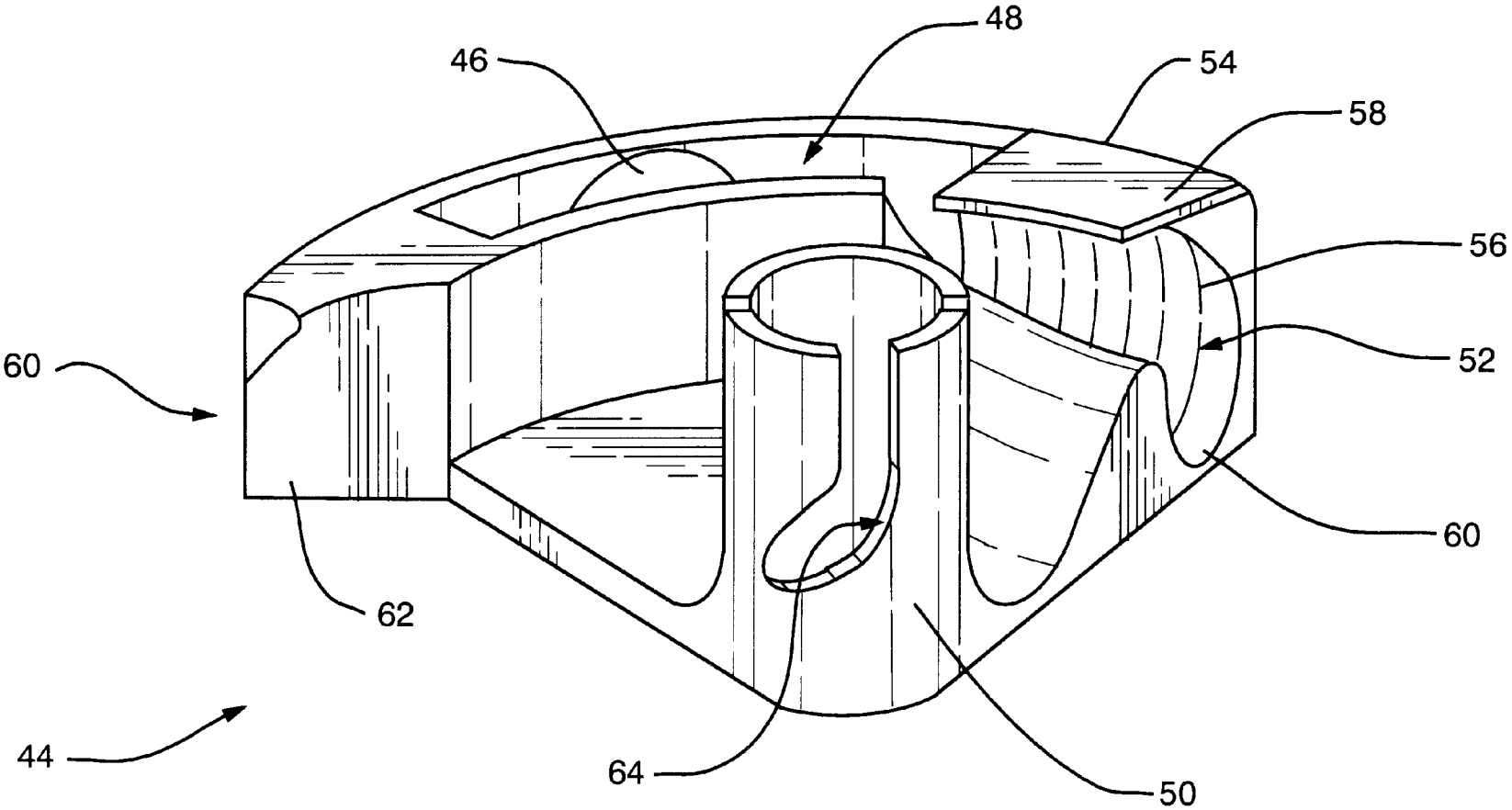
FIG. 5 is a side isometric view of the preferred object sorter.
Figure 6:
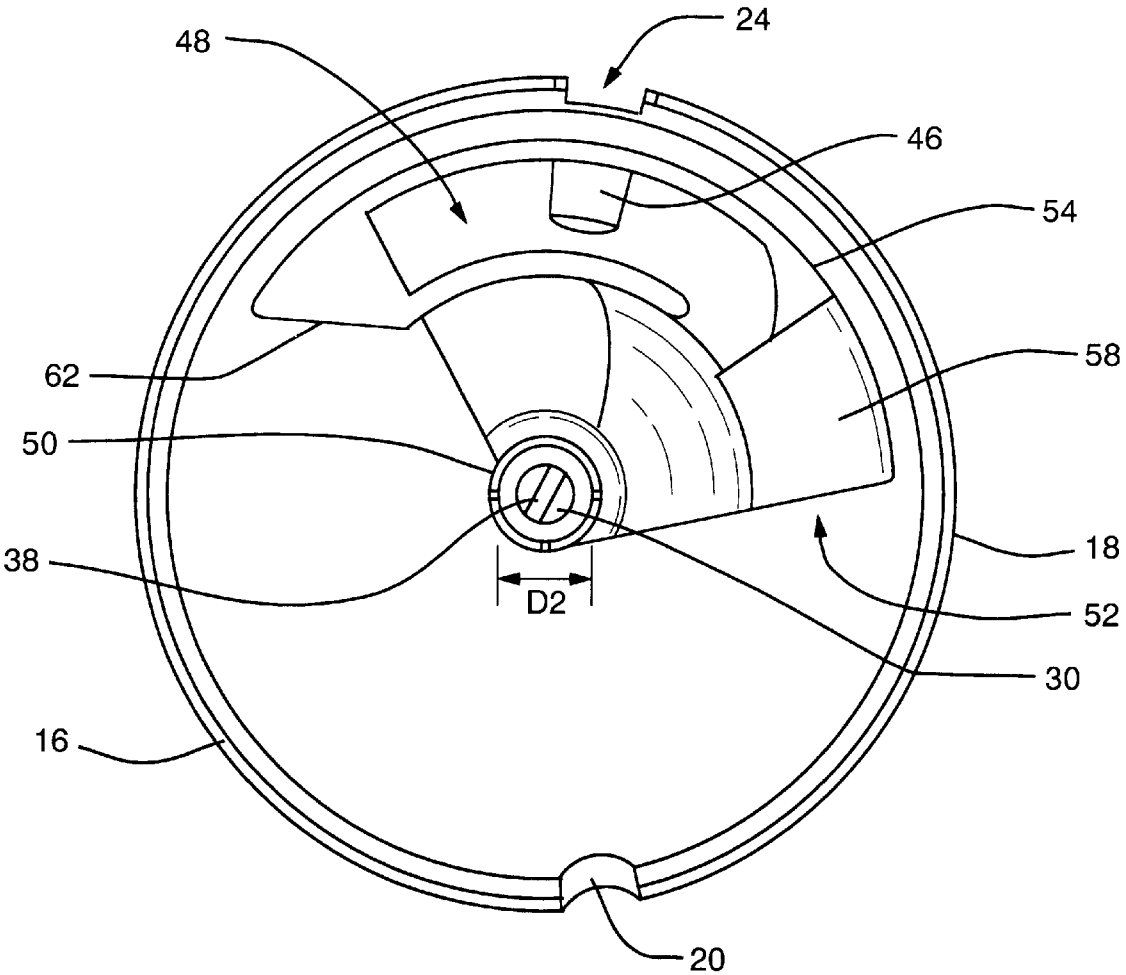
FIG. 6 is a top view of the preferred object sorter mounted within the bottom portion of the preferred housing.

The dispensing apparatus 10 also includes an object sorter 44 for aligning the objects for individual dispensing through the dispensing opening 20 of the housing 12. Referring now to FIGS. 5 and 6, the preferred object sorter 44 includes an object opening 46 dimensioned to allow the single candy to be dispensed, a sorting channel 48, and a second hollow shaft 50 having an inside diameter D2 dimensioned to fit about the first hollow shaft 32 of the plunger 28.

The sorting channel 48 is dimensioned to align a plurality of candies for dispensing and includes a channel entrance 52 to accept and align a single additional candy when a candy has been dispensed. In the preferred embodiment, the channel entrance 52 includes narrowed bottom portion 60, dimensioned to orient a single candy in the position for alignment within the sorting channel 48, and a sloped sidewall 56 that terminates in a retaining plate 58. The sloped sidewall 56 is dimensioned to provide a smooth transition from the channel entrance 52 into the sorting channel 48, while the retaining plate 58 is dimensioned to prevent candies from entering through the top of the sorting channel 48. Although the retaining plate 58 is shown as a separate member that is attached to the object sorter 44. it is recognized that the object sorter 44 may be manufactured as a single unit via machining, injection molding, or a combination of these manufacturing techniques. Similarly, the retaining plate 58 may be formed as part of the top portion 14 of the housing 12 rather than part of the object sorter 44.

The outside surface 54 of the object sorter 44 is rounded and is disposed a sufficient distance from the second hollow shaft 50 to allow the object sorter 44 to rotate about the post 30 while preventing candies from lodging between the outside surface 54 and the area about the periphery 18 of the inside of the housing 12. Finally, the end 60 of the object sorter 44 opposite the channel entrance 52 includes a sloped surface 62 that prevents candies from being lodged between the end 60 object sorter 44 and the area about the periphery 18 of the inside of the housing 12, and to allow the candies to fill the channel entrance 52 with a minimum of shaking.

The second hollow shaft 50 includes a cam slot 64 dimensioned to accept the pin 34 of the plunger 28 and to cause the object sorter 44 to rotate about the first hollow shaft 32 when the plunger 28 is depressed such that the object opening 46 of the object sorter 44 is aligned with the dispensing opening 20 of the housing. FIG. 6 shows the object sorter 44 in such a rotated position.

Figure 7:
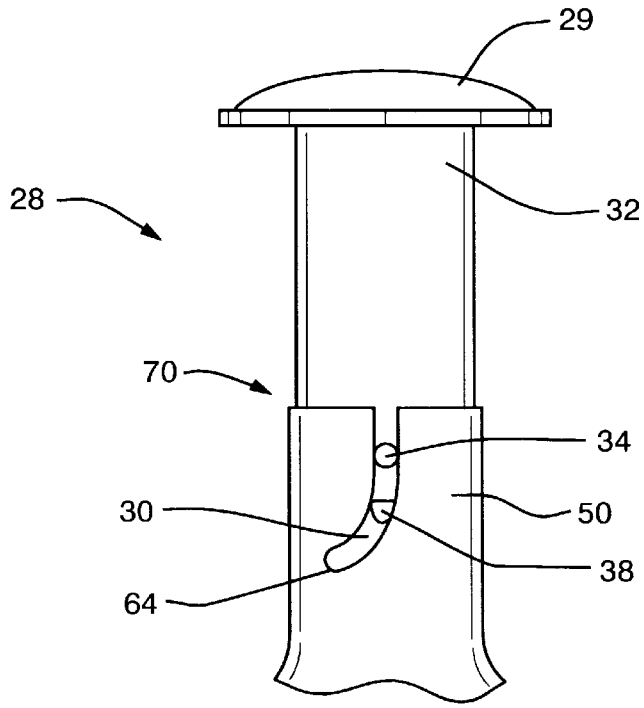
FIG. 7 is a side view of the preferred actuator in an undepressed position relative to the second hollow shaft of the object sorter.
Figure 8:
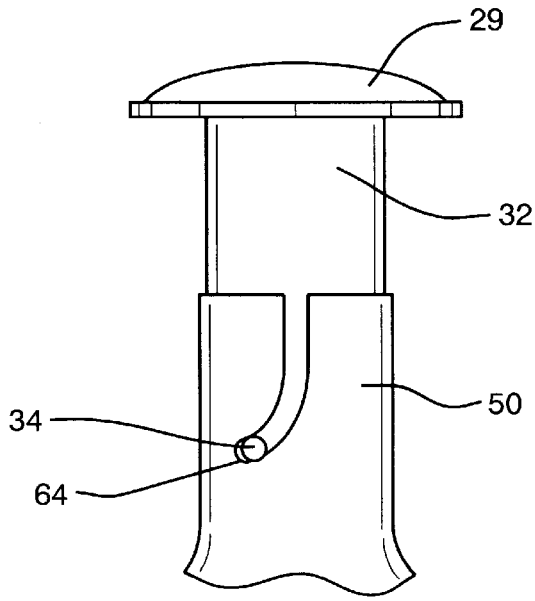
FIG. 8 is a side view of the preferred actuator in an depressed position relative to the second hollow shaft of the object sorter.

FIGS. 7 and 8 demonstrate the interaction between the plunger 28 and post 30 of the preferred actuator 70 and second hollow shaft 50 of the object sorter 44. When the preferred actuator 70 and object sorter 44 are combined, the pin 34 through the first hollow shaft 32 of the plunger is aligned with the slot 38 in the post 30 and with the cam slot 64 of the second hollow shaft 50 of the object sorter 44. In this undepressed orientation, the spring (not shown) maintains the pin 34 of the plunger 28 at within the top portion of the cam slot 64.

Depressing the plunger 28 causes the pin 34 to travel downward into the slot 38 in the post 30 and the can slot 64 of the second hollow shaft 50. Because the shaft 30 is fixed within the bottom portion of the housing, (not shown) the downward movement of the pin 34 into the cam portion of the cam slot 64 causes the object sorter 44 to rotate about the shaft 30. This rotation is controlled by dimensioning the slot 30. cam slot 64, and shaft 32 of the plunger 25 such that a full depression of the plunger 28 causes the object opening 46 of the object sorter to align the dispensing opening 20 of the housing 12 such that the single candy is dispensed, and such that when the plunger 28 is released, the object sorter 44 rotates back into position and additional candies are prevented from being dispensed.

Although the preferred actuator 70 utilizes the plunger 28 and shaft 32 arrangement described above, it is recognized that other actuators 70 would be readily apparent to those of ordinary skill in the art. For example, an alternative embodiment of the invention may include a slot disposed adjacent to the dispensing opening 20 along the periphery 18 of the housing 12 and a lever extending from the object sorter 44 through the slot and serving as the actuator 70. In such an embodiment, a candy is dispensed by moving the lever relative to the dispensing opening 20 to align the object opening 46 with the dispensing opening 20. In some such embodiments, a spring is provided to move the lever back to its original position after dispensing.

In still other embodiments, the object sorter 44 is integral to the top portion 14 or bottom portion 16 of the housing, and the top portion 14 and bottom portion 16 of the housing 12 are made rotatable relative to one another. In these embodiments, the top portion 14 or bottom portion 16 of the housing 12 serves as the actuator 70, and a candy is dispensed by rotating the top portion 14 and bottom portion 16 relative to one another until the object opening 46 is aligned with the dispensing opening 20.

Figure 9:
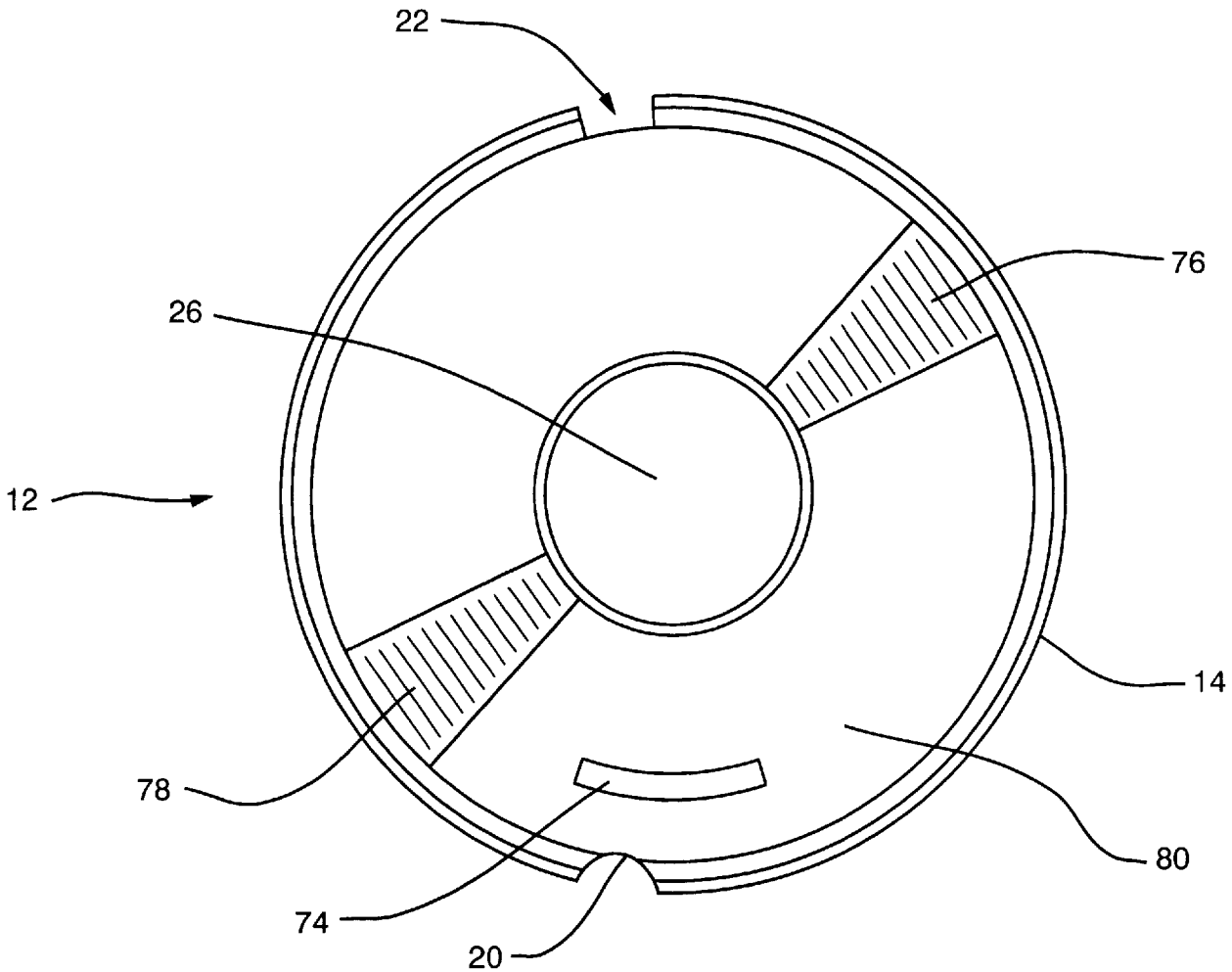
FIG. 9 is a top view of the inside of the top portion of the preferred housing.
Figure 10:
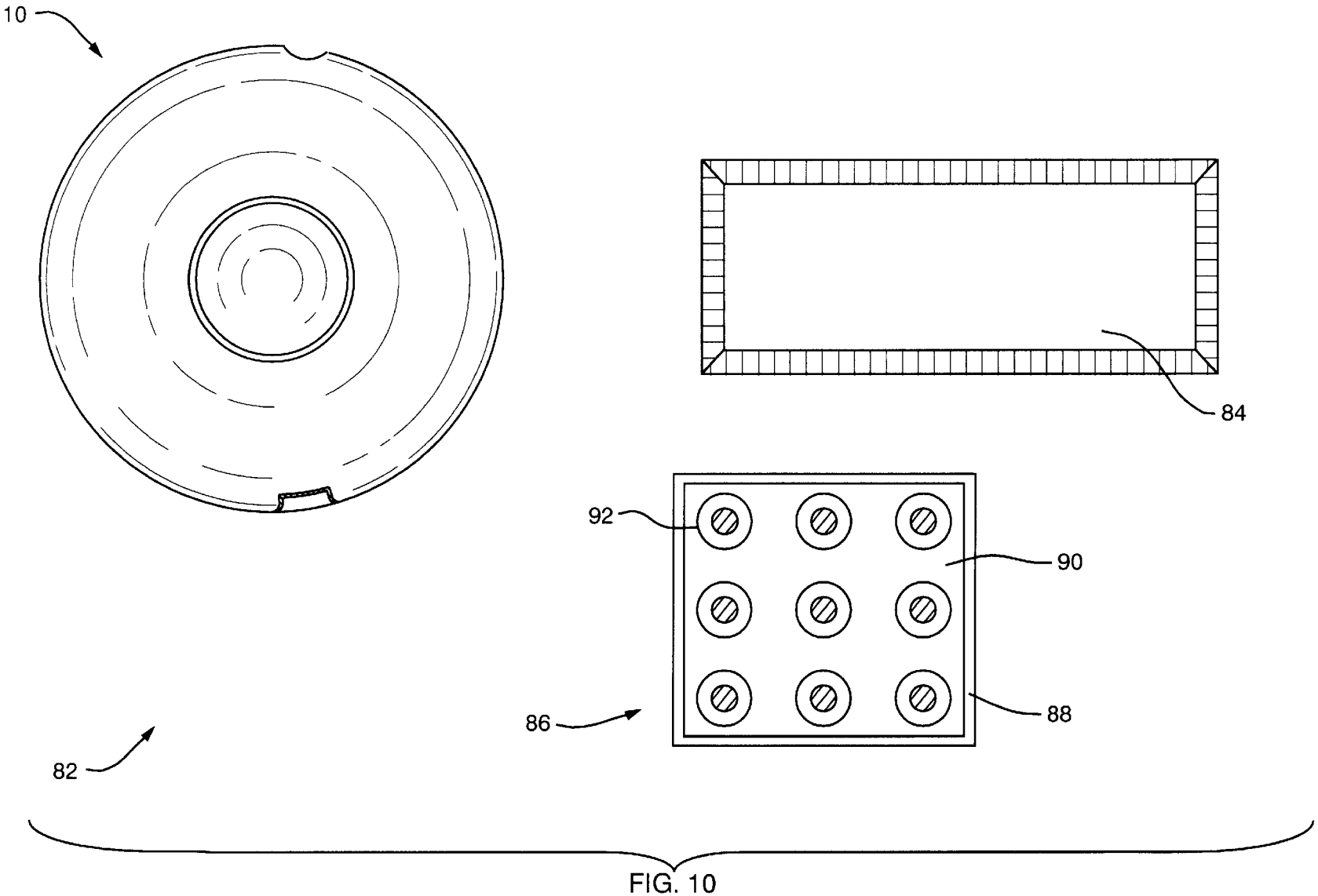
FIG. 10 is a top view of one embodiment of the kit of the present invention.

Referring now to FIG. 9, the top portion 14 of the preferred housing 12 is shown. The preferred top portion 14 includes a guard member 74 extending downward into the interior portion of the housing 12 adjacent to the dispensing opening 20. The guard member 74 is dimensioned to extend into the open top of the sorting channel 48 of the object sorter 44 to further ensure that only a single candy is dispensed at one time. The top portion 14 also includes a pair of sloped portions 76, 78 that meet with a substantially planar platform portion 80 proximate to the guard member 74 and dispensing opening 20. The sloped portions 76, 78 are dimensioned to prevent top loading of the candies into the object sorter, which allows only a single candy to enter the object sorter at one time As shown in FIG. 10, it is contemplated that the dispensing apparatus 10 will be sold as part of a kit 82 along with suitable objects 84 and game cards 86. The preferred game cards 86 include a molded plastic shell 88 and a printed game card 90 that includes colors corresponding to colors of object 84 to be dispensed. The preferred shells 88 have half-saucer shaped indentations 92 upon their top surfaces 94 for receiving saucer shaped objects 84, such as candies.

As noted above, the preferred objects 82 are M&M's® Chocolate Candies. However, it is recognized that the dispensing apparatus may easily be adapted to dispense other brands and types of candies, such as SKITTLES® Fruit Flavored Candies. Further, it is contemplated that the dispensing apparatus may also be adapted dispense non-candy objects, such as marbles. discs, rings. or the like.

The dispensing apparatus 12 and kit 82 may be utilized to play a number of games according to the method of the present invention. In some embodiments, the method of includes the steps of inserting a plurality of objects into a dispenser, randomly dispensing at least a first object from the dispenser, passing the dispenser to another player. randomly dispensing at least a second object from the dispenser. repeating the dispensing steps until the game is complete, and determining a winner of the game based upon the objects that have been dispensed.

A number of games may be played using the above method. For example, a variation of a dice game may be played in which the player will dispense two object and determine their total numerical value just as with dice.

A "guessing" game may be played where, before dispensing an object, a player will guess its color. If the player then dispenses the guessed color, the play continues to dispense and guess until not guessing the right color. Whoever has the most objects at the end of the dispensing wins the game.

A "special" game may be played in which a specially object is placed in the dispenser and players alternate dispensing until the special object is dispensed. The player that dispenses the special object may either win or lose depending upon what was agreed upon prior to playing.

A "color" game may be played in which a player will continue to dispense objects until a specified color is dispensed. The winner is the player with the most, or fewest. number of objects after all objects are dispensed.

An "empty" game may be played in which each player will dispense one object. in turn, until the dispenser is empty. Each player will determine the numerical value of their objects and add or multiply these values. The player with the highest or lowest total or the one with the highest or lowest total of one color, wins.

A "total" or "blackjack" type game may be played in which a number is specified and the first player to have objects with a numerical total equal to, but not exceeding, that number wins. Any player having a total that is greater is out of the game. The higher the number, the more challenging and fun.

A "value" game may be played in which a player will dispense one object. determine its numerical value, and then dispense as many additional objects as the numerical value. The player with the most, or fewest, objects at the end of dispensing will win.

Finally, a "math" game may be played in which a player will dispense a specified number of objects, determine the numerical value of each, and add, multiply, or divide their value.

In other embodiments of the method, a game card 88 is utilized in order to play the game. For example, a "bingo" type game may be played in which the dispenser will be handed to each player in turn and each player will dispense one object If the color of the object matches the color of an empty space on their game card 88, they will place it there. The first player to fill all indentations 92 on the game card 88 wins.

A "tic-tac-toe" type game may also be played. Such a game is similar to "bingo" except the winner has to get three objects in a row of indentation 92 on the game card 88.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A dispensing apparatus for randomly dispensing a plurality of objects, said apparatus comprising:

a housing having a substantially hollow interior portion for holding a plurality of said objects and a dispensing opening dimensioned to allow a single object to be dispensed;

a object sorter for aligning said objects for individual dispensing through said dispensing opening of said housing; and an actuator for individually dispensing said single object from said object sorter through said dispensing opening of said housing;

wherein said object sorter comprises an object opening dimensioned to allow said single object to be dispensed therethrough, and a means for rotating said object sorter a sufficient distance to align said object opening of said object sorter with said dispensing opening of said housing such that said single object is dispensed; and wherein said objects are held within said housing and are randomly aligned within said object sorter such that a user will not know which of said objects will be dispensed when said actuator is actuated.

2. The apparatus as claimed in claim 1 wherein said objects are saucer shaped candies and said dispensing opening of said housing is dimensioned to allow a single candy to be dispensed.

3. The apparatus as claimed in claim 2 wherein said housing comprises a top portion and a bottom portion. wherein said top portion and said bottom portion are attached together about a periphery of said housing, and wherein dispensing opening is disposed through said periphery of said housing.

4. The apparatus as claimed in claim 3 wherein said actuator comprises a plunger disposed through said top portion of said housing and wherein said actuator dispenses said single candy when said plunger is depressed.

5. The apparatus as claimed in claim 4:

wherein said actuator further comprises a post extending from said bottom portion of said housing and comprising a slot;

wherein said plunger comprises a first hollow shaft having an inside diameter dimensioned to fit around said post and a pin disposed across said inside diameter of said first hollow shaft and extending through an outer surface of said shaft, said pin being dimensioned to fit within said slot in said post to prevent rotation of said plunger; and wherein said object sorter comprises a second hollow shaft having an inside diameter dimensioned to fit about said first hollow shaft, said second hollow shaft comprising a cam slot dimensioned to accept said pin and to cause said object sorter to rotate about said first hollow shaft when said plunger is depressed;

wherein depressing said plunger causes said object sorter to rotate a sufficient distance to align said object opening of said object sorter with said dispensing opening of said housing such that said single candy is dispensed.

6. The apparatus as claimed in claim 5 wherein said plunger further comprises a spring disposed within said first hollow shaft, said spring being dimensioned to engage said pin when said plunger is depressed and to return said plunger and said object sorter to an unengaged position when said plunger is released.

7. The apparatus as claimed in claim 6 wherein said top portion of said housing further comprises a guard member extending downward into said interior portion of said housing, said guard member being dimensioned and disposed a sufficient distance from said dispensing opening such that only said single candy may be dispensed when said plunger is depressed.

8. The apparatus as claimed in claim 7 wherein said top portion of said housing further comprises a pair of sloped portions proximate to said guard member and said dispensing opening, said sloped portions being dimensioned to prevent more than a single candy from entering said object sorter at one time.

9. The apparatus as claimed in claim 5 wherein said object sorter further comprises a sorting channel, said sorting channel being dimensioned to align a plurality of candies for dispensing and to accept and align an additional candy when a candy has been dispensed.

10. The apparatus as claimed in claim 1 wherein said housing is formed in a shape of said object to be dispensed.

11. The apparatus as claimed in claim 10 wherein said object is a saucer shaped candy and wherein said housing is formed in a shape of said saucer shaped candy.

12. The apparatus as claimed in claim 11 wherein said housing further comprises a means for filling said interior portion of said housing with at least one candy.

13. A kit of parts for use in playing a game, said kit comprising:

a plurality of objects;

an apparatus for randomly dispensing said plurality of objects, said apparatus comprising;

housing having a substantially hollow interior portion for holding a plurality of said objects and a dispensing opening dimensioned to allow a single object to be dispensed;

a object sorter for aligning said objects for individual dispensing through said dispensing opening of said housing; and an actuator for individually dispensing said single object from said object sorter through said dispensing opening of said housing;

wherein said object sorter comprises an object opening dimensioned to allow said single object to be dispensed therethrough, and a means for rotating said object sorter a sufficient distance to align said object opening of said object sorter with said dispensing opening of said housing such that said single object is dispensed; and wherein said objects are held within said housing and are randomly aligned within said object sorter such that a user will not know which of said objects will be dispensed when said actuator is actuated.

14. The kit as claimed in claim 13 further comprising at least one game card, said game card having a top surface dimensioned to accept and maintain a plurality of said objects in a predetermined position.

15. The kit as claimed in claim 14, wherein said objects are saucer shaped candies.

16. A method of playing a game comprising the steps of:

inserting a plurality of objects into a dispenser;

randomly dispensing at least a first object from said dispenser;

passing said dispenser to another player;

randomly dispensing at least a second object from said dispenser; and determining a winner of said game based upon said objects that have been dispensed.

17. The method as claimed in claim 16 further comprising the steps of placing a first plurality of objects into a first game card; and placing a second plurality of objects into a second game card;

wherein said step of determining a winner of said game comprises the steps of determining a winner of said game based upon a pattern of said objects placed into said first game card and said second game card.

* * * * *